US010648127B2

(12) United States Patent
D'Oliviera Dias et al.

(10) Patent No.: US 10,648,127 B2
(45) Date of Patent: May 12, 2020

(54) STEAM IRONING AND/OR SMOOTHING APPLIANCE COMPRISING AN IRONING BOARD THAT CAN BE IMMOBILIZED IN VARIOUS TILTED POSITIONS

(71) Applicant: SEB S.A., Ecully (FR)

(72) Inventors: Laurent D'Oliviera Dias, Saint-Chamond (FR); Nicolas Lauchet, Estrablin (FR); Florent Peysselon, Lyons (FR)

(73) Assignee: SEB S.A., Ecully (FR)

( * ) Notice: Subject to any disclaimer, the term of this patent is extended or adjusted under 35 U.S.C. 154(b) by 82 days.

(21) Appl. No.: 16/021,794

(22) Filed: Jun. 28, 2018

(65) Prior Publication Data

US 2019/0003110 A1 Jan. 3, 2019

(30) Foreign Application Priority Data

Jun. 29, 2017 (FR) ..... 17 56063

(51) Int. Cl.
*D06F 81/08* (2006.01)
*D06F 81/00* (2006.01)
(Continued)

(52) U.S. Cl.
CPC ..... *D06F 81/08* (2013.01); *A47B 9/20* (2013.01); *D06F 73/00* (2013.01); *D06F 81/00* (2013.01); *A47B 2009/003* (2013.01)

(58) Field of Classification Search
CPC ..... D06F 81/00; D06F 75/00; D06F 73/00; D06F 87/00; A47B 9/20; A47B 9/003;
(Continued)

(56) References Cited

U.S. PATENT DOCUMENTS 2,689,157 A * 9/1954 Di Censo ..... A47B 19/06 108/5
3,795,379 A * 3/1974 Gray ..... A47B 57/045 248/242

(Continued)

FOREIGN PATENT DOCUMENTS

CN 105671927 A 6/2016
CN 103334281 B 8/2016

(Continued)

OTHER PUBLICATIONS

French Search Report as issued in French Patent Application No. 1756063, dated Mar. 12, 2018.

*Primary Examiner* — Ismael Izaguirre
(74) *Attorney, Agent, or Firm* — Pillsbury Winthrop Shaw Pittman LLP

(57) ABSTRACT

A steam ironing and/or smoothing appliance including an ironing board against which a garment to be ironed can be placed for a steam treatment, the ironing board being mounted with the ability to pivot by a hinge device enabling the ironing board to be immobilized in various tilted positions, the hinge device including a first part which is mobile in rotation in relation to a second part, the first part including at least one notch in which is engaged at least one locking element carried by the second part in order to prevent the hinge device from rotating, wherein the second part is mobile in translation in relation to the first part according to a course and a direction enabling the locking element to engage and disengage in the notch.

12 Claims, 5 Drawing Sheets

(51) Int. Cl.

| | |
|---|---|
| ***D06F 73/00*** | (2006.01) |
| ***A47B 9/20*** | (2006.01) |
| *A47B 81/00* | (2006.01) |
| *A47B 9/00* | (2006.01) |

(58) Field of Classification Search

CPC .. A47B 9/02; A47B 3/00; A47B 3/002; A47B 3/0818; A47B 3/083; A47B 57/04; A47B 13/02; A47B 81/00; A47B 2009/003; G06F 1/16

USPC ..... D32/66

See application file for complete search history.

(56) References Cited

U.S. PATENT DOCUMENTS

| | | | | | |
|---|---|---|---|---|---|
| 3,848,543 | A * | 11/1974 | Johnston | A47B 57/04 | 108/5 |
| 4,350,098 | A * | 9/1982 | Shirono | H05K 7/18 | 108/6 |
| 4,441,432 | A * | 4/1984 | Carlton | A47B 37/02 | 108/139 |
| 4,956,929 | A * | 9/1990 | Chirabandalsuk | D06F 81/00 | 108/6 |
| 6,837,467 | B2 * | 1/2005 | Cheng | A47B 46/005 | 108/108 |
| 8,205,363 | B2 * | 6/2012 | Lin | D06F 75/40 | 38/77.6 |
| 2010/0095565 | A1 | 4/2010 | Ma et al. | | |
| 2015/0223600 | A1 * | 8/2015 | Pan | A47B 41/02 | 108/91 |

FOREIGN PATENT DOCUMENTS

| | | | |
|---|---|---|---|
| EP | 3 111 003 | A1 | 1/2017 |
| WO | WO 2004/023957 | A2 | 3/2004 |
| WO | WO 2016/116298 | A1 | 7/2016 |
| WO | WO 2016/124705 | A1 | 8/2016 |

* cited by examiner

STEAM IRONING AND/OR SMOOTHING APPLIANCE COMPRISING AN IRONING BOARD THAT CAN BE IMMOBILIZED IN VARIOUS TILTED POSITIONS

CROSS REFERENCE TO RELATED APPLICATIONS

This application claims priority to French Patent Application No. 1756063, filed Jun. 29, 2017, the entire content of which is incorporated herein by reference in its entirety.

FIELD

This invention relates to a steam ironing and/or smoothing appliance comprising an ironing board against which a garment can be placed for a steam treatment, and relates more specifically to an appliance in which the ironing board is mounted with the ability to pivot by means of a hinge device enabling the ironing board to be immobilized in various tilted positions.

BACKGROUND

From the patent application WO2016116298, a steam ironing appliance is known comprising a base containing a steam generator connected by a pipe to a smoothing head comprising steam outlet openings. In that document, the base comprises two telescopic poles which support an ironing board on which the garment to be ironed may rest during the steam treatment of the garment, the ironing board being mounted with the ability to pivot by means of a hinge device enabling the ironing board to be immobilized in various tilted positions.

Such a steam ironing/smoothing appliance has the advantage of having an ironing board whose tilt can be changed by means of a hinge device, for better ergonomics of use.

However, such an appliance has the disadvantage of having a hinge device equipped with a spring locking system which is relatively costly to manufacture. In addition, to unlock the hinge device and enable the ironing board to pivot, the user must actuate the unlocking button while grasping the ironing board in order to change its tilt. Such a manipulation is not easy, because the unlocking button is found on the hinge device, that is, at a location which is both distant from the ironing board and hidden by the latter. Finally, there is a risk that the user's finger may be pinched by the return of the unlocking button under the effect of its return spring.

SUMMARY

An aspect of this invention is to propose an ironing appliance to correct these disadvantages that is both simple and economical to make.

For this purpose, an aspect of this invention is a steam ironing and/or smoothing appliance comprising an ironing board against which a garment to be ironed can be placed for a steam treatment, the ironing board being mounted with the ability to pivot by means of a hinge device enabling the ironing board to be immobilized in various tilted positions, the hinge device comprising a first part which is mobile in rotation in relation to a second part, the first part comprising at least once notch in which is engaged at least one locking element carried by the second part in order to prevent the hinge device from rotating, characterized in that the second part is mobile in translation in relation to the first part according to a course and a direction enabling the locking element to engage and disengage in the notch.

Such a characteristic makes it possible to lock and unlock by simply moving the ironing board in translation in relation to the rest of the appliance in order to engage or disengage the locking element through the notch. Thus, to change the tilt of the board, the user may simply grasp the ironing board with both hands to move it in translation in order to unlock the hinge device, then pivot the ironing board into the desired position, and finally lock the hinge device in the new position by again moving the ironing board in translation to bring the locking element into a new notch or bring a new locking element into the notch.

According to another characteristic of the invention, the position and form of the notch are adapted so that the locking element automatically engages in the notch under the effect of the weight of the ironing board.

Such a characteristic makes it possible to automatically lock the hinge device in the various tilted positions of the ironing board solely by means of gravity, that is, without using a spring device. The locking achieved in this manner is very ergonomic to use and simple and economical to implement.

According to another characteristic of the invention, the locking element is incapable of translational motion on the second part.

According to another characteristic of the invention, the locking element is fixedly mounted on the second part.

Such a characteristic permits having a locking element simply fixed to the second part, or directly integrated in the body of the second part, making it very simple to construct.

According to another characteristic of the invention, the hinge device permits immobilizing the ironing board in at least one horizontal position, one vertical position and one intermediate position between the vertical position and the horizontal position.

Such a characteristic permits optimizing the appliance's ergonomics of use by offering three positions with three very different ergonomics of use.

According to another characteristic of the appliance, in the intermediate position, the ironing board forms an angle of between 15° and 60° with respect to the vertical plane, and preferably of approximately 40°.

Such an intermediate position has the benefit of both enabling a good position of the garment to be ironed on the ironing board under the action of gravity, and ensuring the comfort of the user who wishes to do the ironing. In fact, this intermediate position offers good visual access to the garment and permits applying significant tension to the garment using a smoothing tool, such as a smoothing brush or an iron.

According to another characteristic of the invention, the second part comprises several locking elements.

Such a characteristic permits having several locking elements cooperating with the same notch in the first part of the hinge device in order to immobilize the hinge device in various angular positions.

According to another characteristic of the invention, the locking element has the form of a cylindrical finger or a tooth.

Such a locking element has the benefit of being simple and economical to make.

According to another characteristic of the invention, the first part comprises several notches.

Such a characteristic permits having several notches cooperating with the same locking element in the second part of the hinge device in order to immobilize the hinge device in various angular positions.

According to another characteristic of the invention, the notch is open at its upper end and beneficially is trapezoidal in shape.

Such a characteristic permits having a notch whose shape and orientation are particularly adapted to ensure that the locking element engages automatically in the notch, under the action of gravity.

According to another characteristic of the invention, the hinge device comprises a finger, carried by either the first or second part, which is mounted with the ability to slide in a groove arranged in the other of the first or second part, the finger being able to pivot freely in the groove.

Through a construction that is particularly simple, reliable and economical to implement, such a characteristic achieves an articulation permitting the first part to be mobile in translational motion and mobile in rotation in relation to the second.

According to another characteristic of the invention, the appliance comprises at least one pole which supports the ironing board, the first part being fixed to the top of the pole and the second part being fixed to the ironing board.

According to another characteristic of the invention, the pole is telescopic. Such a characteristic permits adjusting the height of the ironing board. According to another characteristic of the invention, the pole is arranged vertically.

According to another characteristic of the invention, the appliance comprises two parallel poles which support the ironing board.

According to another characteristic of the invention, the hinge device comprises two identical hinge systems at the end of each pole.

According to another characteristic of the invention, the appliance comprises a base containing a water tank, the base being connected by a flexible pipe to a smoothing tool comprising at least one hole for emission of steam, such as a smoothing brush or an iron.

According to another characteristic of the invention, the base contains a steam generator.

According to another characteristic of the invention, the pipe directly connects the smoothing tool to a boiling chamber arranged in the base such that the steam produced by the boiling chamber escapes freely toward the smoothing tool.

According to another characteristic of the invention, the base comprises an electric pump to send water from the tank toward the smoothing tool, the smoothing tool comprising an instant vaporization chamber.

Such a characteristic permits having a base that is compact and very simple to make, the steam being produced directly in the vaporization chamber carried by the smoothing tool.

According to another characteristic of the invention, the pole or poles are fixed to a stand on which the base rests.

Such a characteristic permits separating the structure supporting the board from the structure of the base, so that these two sub-assemblies can be constructed separately.

According to another characteristic of the invention, the base is removably mounted on the stand.

Such a characteristic permits using the base and the smoothing tool associated with it independently of the structure supporting the ironing board.

According to another characteristic of the invention, the ironing board has a generally rectangular shape.

According to yet another characteristic of the invention, the ironing board is more than 60 cm in length and more than 30 cm in width.

BRIEF DESCRIPTION OF THE DRAWINGS

The objects, aspects, and benefits of this invention will be more fully understood in consideration of the following description of two particular embodiments of the invention presented as non-restrictive examples, by referring to the attached drawings in which.

Only the elements necessary for understanding the invention have been represented. To facilitate reading of the drawings, the same elements bear the same references from one figure to the next. Note that in this document, the terms "horizontal," "vertical," "lower," "upper," "front" and "back" used to describe the appliance refer to this appliance when its base rests flat on the floor as illustrated in FIG. 1.

Figure 1:
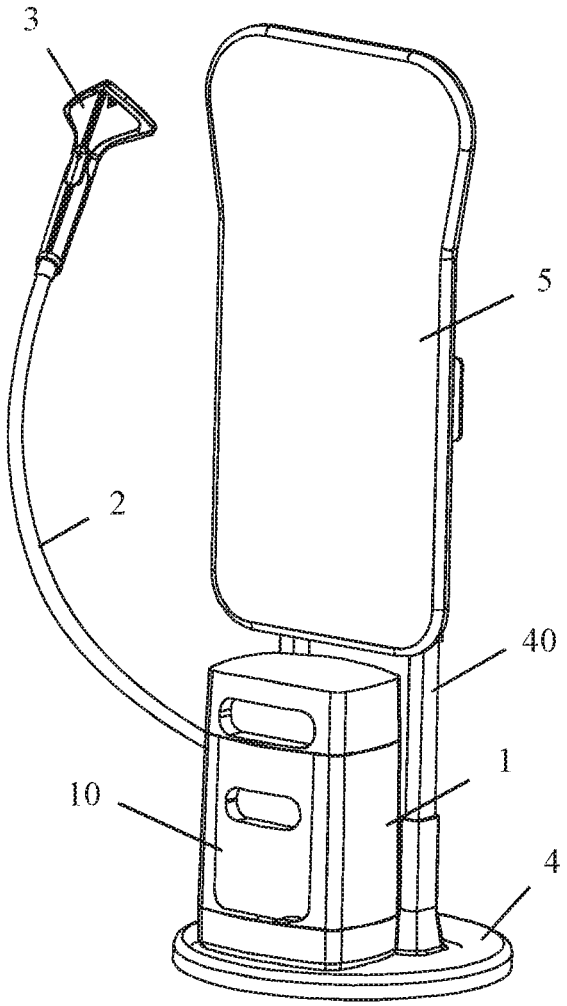
FIGS. 1 and 2 are perspective views of an ironing appliance according to a first particular embodiment of the invention with the ironing board in a vertical position.
Figure 2:
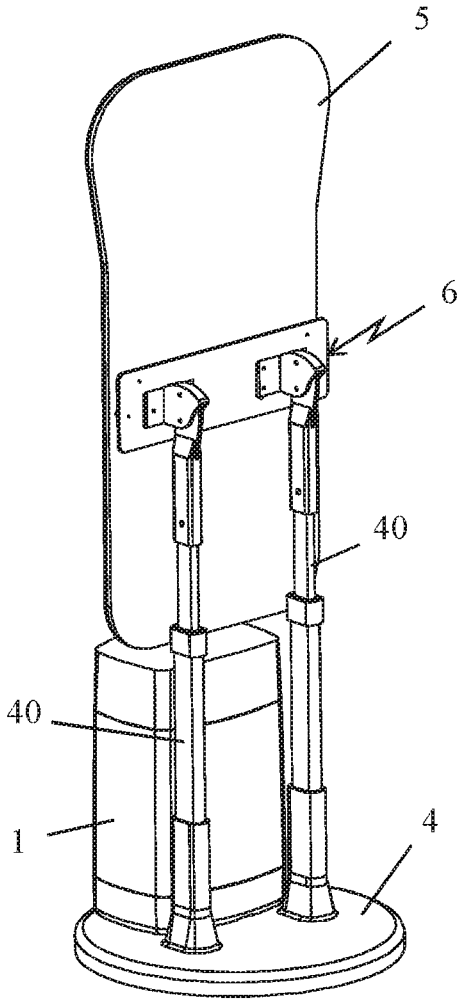

FIGS. 1, 2 represent a steam ironing appliance comprising a base 1 for steam generation connected by a flexible pipe 2 to a smoothing brush 3 comprising holes for emission of steam, illustrated only in FIG. 1.

The base 1 comprises, in a manner known per se, a water tank 10 connected to a boiling chamber, not represented in the figures, permitting the continuous production of a stream of saturated steam, the boiling chamber being connected directly to the flexible pipe 2 such that the steam produced by the boiling chamber can escape freely toward the steaming brush 3.

Such a base 1 for steam generation is well known to those skilled in the art, and is, for example, technically similar to the base for steam generation described in detail in the patent application WO2004/023957.

In accordance with FIG. 2, the appliance also comprises a stand 4 on which the base 1 rests, the stand 4 comprising two telescopic poles 40, including an upper end supporting an ironing board 5 on which the clothing to be smoothed may be placed, the ironing board 5 beneficially having a generally rectangular shape, with a slightly widened upper end adapted to hold a shirt or a jacket as a coat hanger would.

Figure 5:
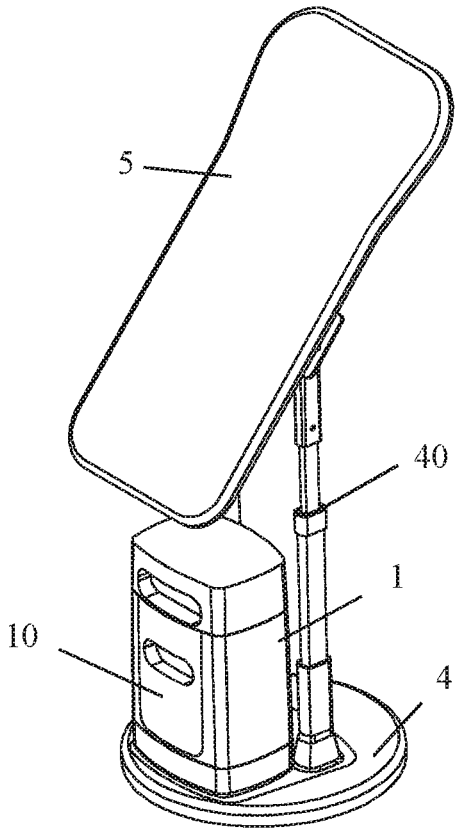
FIGS. 5 and 7 are perspective views of the appliance in FIG. 1 when the ironing board is locked in an intermediate tilt position and in a horizontal position, respectively.

The ironing board 5 is mounted with the ability to pivot on the end of the poles 40 by means of a hinge device 6 to immobilize the ironing board 5 in different tilted positions and beneficially in a vertical position (illustrated in FIGS. 1 and 2), in a horizontal position (illustrated in FIG. 7), and in an intermediate position (illustrated in FIG. 5).

Figure 3:
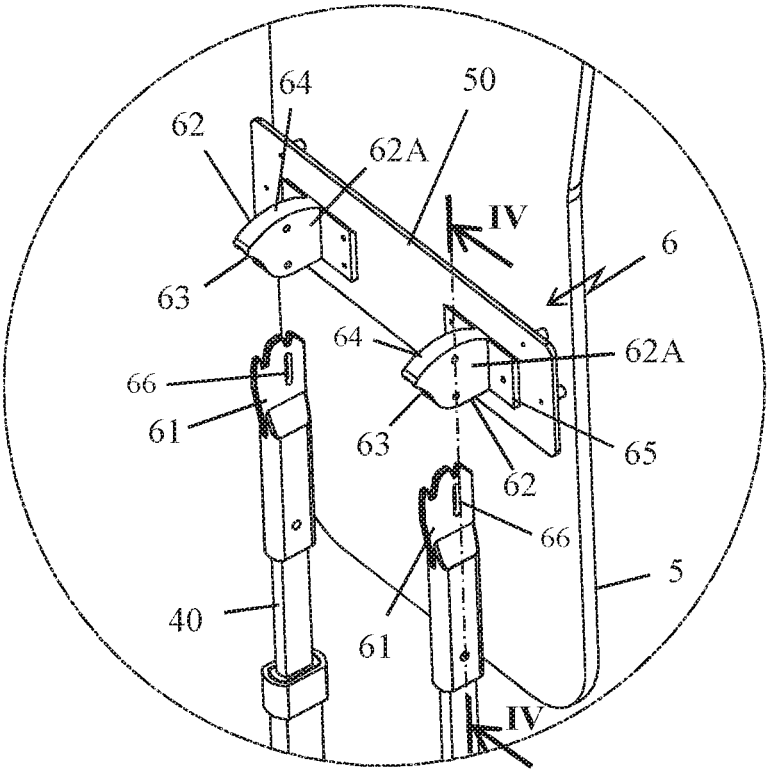
FIG. 3 is an exploded perspective detail view of the hinge device supporting the ironing board of the appliance in FIGS. 1 and 2.

In accordance with FIG. 3, the hinge device 6 comprises, at the end of each pole 40, the same hinge system comprising a first part 61 integral with the upper end of the pole 40 and a second part 62 integral with the ironing board 5.

In the embodiment shown, the first part has the shape of a vertical, rectangular plate 61, with a rounded upper edge, and the second part has the shape of a case 62 with two side flanges 62A having a space between them in which the plate 61 engages.

The case 62 beneficially comprises a side opening 63 by which the plate 61 is engaged between the two flanges 62A and comprises, opposite the side opening 63, a side wall 64 making a rigid connection between the two flanges. The case 62 comprises, at the feet of the side wall 64, a bottom wall 65 which extends on both sides of the flanges 62A and attaches the case 62 to a cross member 50 integral with the rear face of the ironing board 5.

Figure 4:
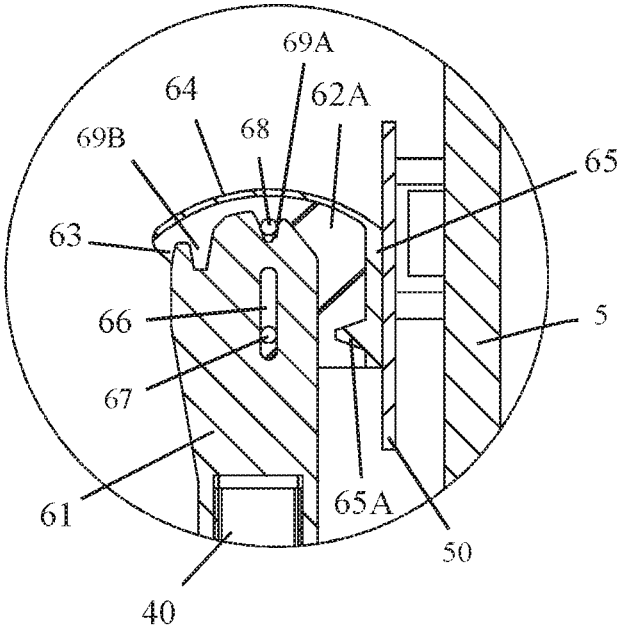
FIG. 4 is a longitudinal cross sectional detail view, according to line IV-IV of FIG. 3, of the hinge device when the board is locked in a vertical position.

In accordance with FIG. 4, the plate 61 comprises a vertical groove 66 in which a finger 67 slides, carried by the case 62, to allow both a vertical translational movement of the case 62 in relation to the plate 61, by translation of the finger 67 in the groove 66, and a pivoting movement of the case 62 around the plate 61, by rotation of the finger 67 in the groove 66.

In the embodiment example illustrated in the figures, the groove 66 extends vertically on a length of approximately 2 cm (i.e., +1-20%) and is approximately 6 mm in width (i.e., +1-20%), the finger being formed by a first cylindrical axle 67 extending perpendicularly between the two side flanges 62A, the first axle 67 being arranged close to the side opening 63 of the case 62 and having a diameter slightly smaller than the width of the groove 66 in order to permit the first axle 67 to slide and pivot freely inside the groove 66.

The case 62 also comprises a second cylindrical axle 68 which extends perpendicularly between the two side flanges 62A, this second cylindrical axle 68 being arranged in the vicinity of the side wall 64 of the case 62 and moving along the periphery of the upper end of the plate 61 when the case 62 is moved according to a pivoting movement around the plate 61.

Figure 6:
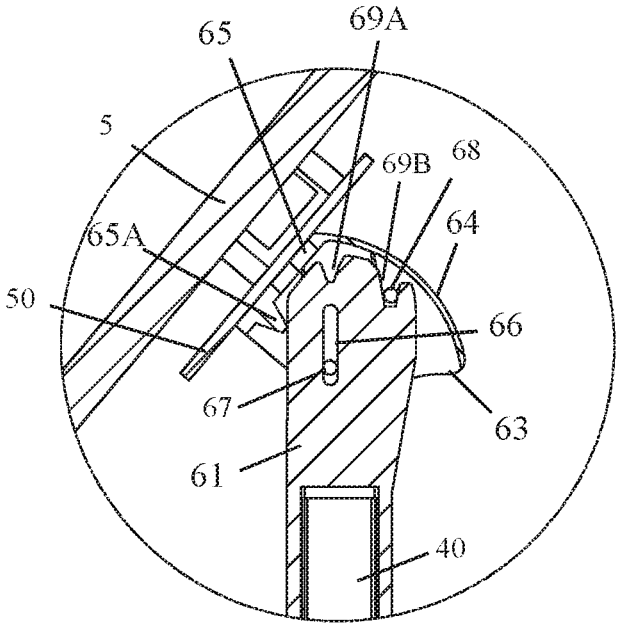
FIGS. 6 and 8 are longitudinal cross sectional detail views of the hinge device when the board is locked in an intermediate tilt position and in a horizontal position, respectively.

As can be seen on FIGS. 4 and 6, the upper edge of the plate 61 comprises a first 69A and a second notch 69B which beneficially are trapezoidal in shape and are greater than 6 mm in depth. The first notch 69A is arranged in alignment with the groove 66 and is intended to hold the second cylindrical axle 68 when the ironing board 5 is in the vertical position, as illustrated in FIGS. 2 and 4.

The second notch 69B is axially offset with respect to the longitudinal axis of the groove 66, toward the back of the appliance, and is intended to hold the second axle 68 when the ironing board 5 is in a titled position in which it forms an angle of approximately 40° (i.e., +/−20%) with respect to the vertical, as illustrated in FIGS. 5 and 6.

Figure 7:
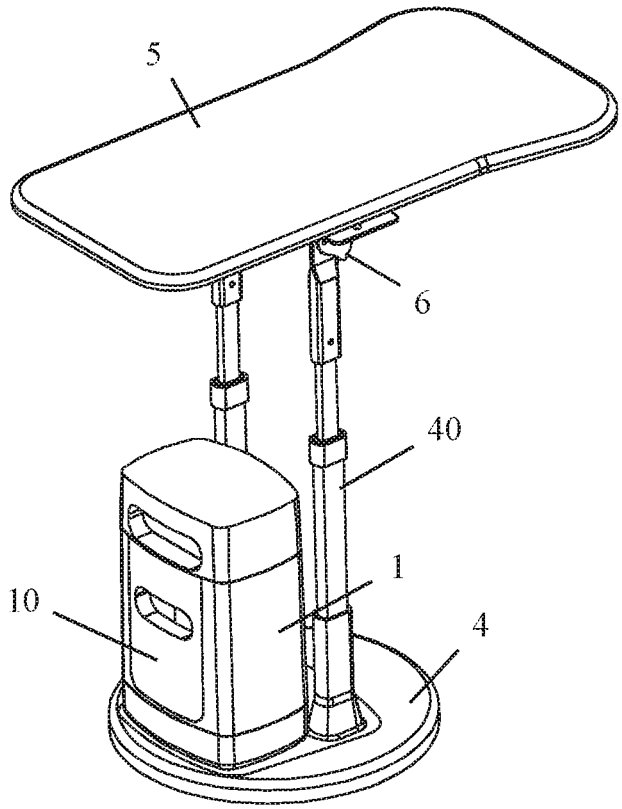
Figure 8:
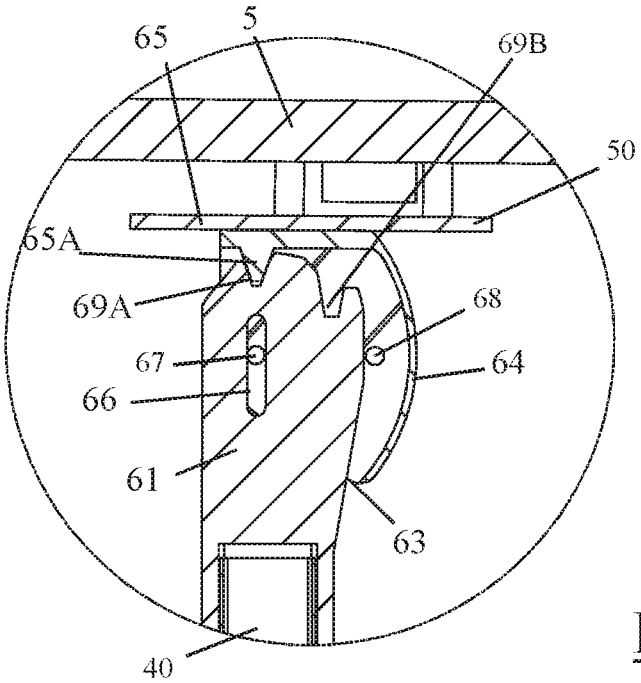

The second notch 69B is also intended to hold a tooth 65A which extends over the bottom wall 65 of the case 62 and engages in the second notch 69B when the ironing board 5 is arranged substantially horizontally, as illustrated in FIGS. 7 and 8.

In this way, a steam ironing appliance is obtained which comprises an ironing board 5 which rests on a hinge device 6 that is simple and economical to make and enables the ironing board 5 to be arranged in three different orientations.

The user can then choose the one that seems best suited for the ironing work to be done, for better ergonomics of use.

In particular, the ironing appliance equipped with such a hinge device 6 has the benefit of being reliable and offering very good ergonomics of use, as the user who wishes to change the tilt of the ironing board 5 has only to raise it on a course of a few millimeters in order to disengage the tooth 65A, or the second axle 68, from the notches 69A, 69B, and then to shift it toward the desired position out of the other two positions offered. During this shifting, the user may beneficially stop raising the ironing board 5 such that the second axle 68 and/or the tooth 65A rest on the top edge of plate 61 and engage automatically, under the effect of the weight of the ironing board 5, in the neighboring notch 69A, 69B when the ironing board 5 reaches one of the other locking positions offered by the hinge device 6.

In addition, the shape of the top edge of the plate 61 in the vicinity of the notches 69A, 69B may be worked to have a more or less pronounced slope in the direction of the notches 69A, 69B and thus shift the ironing board 5 more or less rapidly toward the immobilized position under the effect of the weight of the ironing board 5.

Figure 9:
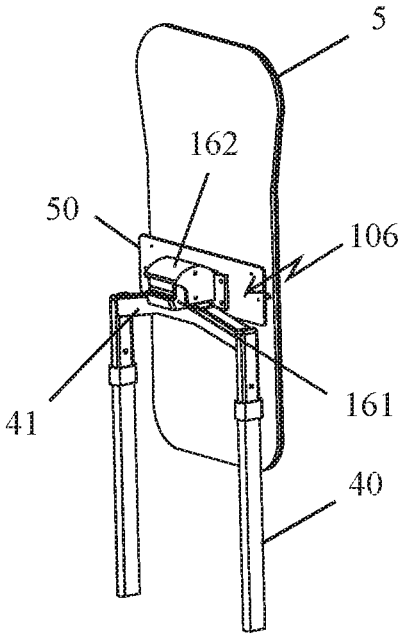
FIGS. 9 and 10 are, respectively, perspective and exploded perspective views of a tilting board system according to a second embodiment of the invention intended to equip the appliance in FIG. 1.
Figure 10:
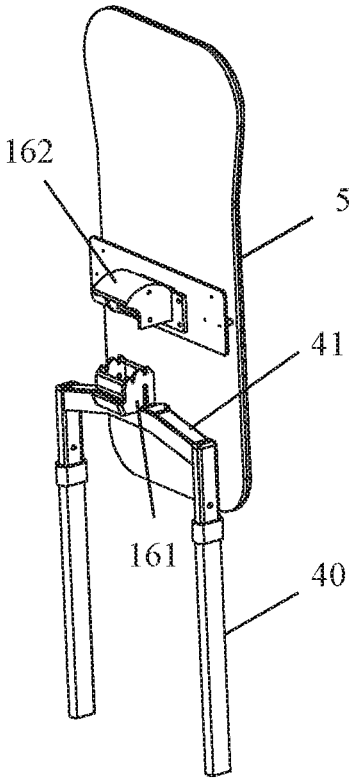

FIGS. 9 and 10 disclose a second embodiment of a tilting board system that may equip the appliance in FIG. 1.

In accordance with these figures, this second embodiment is different from the one described in FIGS. 1 to 8 only in that the two poles 40 are connected to one another at their top end by a crossbar 41 which supports a single hinge device 106 centrally arranged at the summit of the crossbar 41, the hinge device 106 including, in the same subassembly, two vertical plates 161 topped by a case 162 which have characteristics similar, respectively, to the plates 61 and the case 62 of the hinge device described in the first embodiment. The hinge device 106 thus formed operates in a manner similar to the hinge device 6 described in the first embodiment and has the benefit of being centrally positioned, which exposes more of the back face of the ironing board 5 in the vicinity of its peripheral edge and thus offers greater freedom to position a garment.

It will be appreciated that the invention is in no way limited to the embodiments described and illustrated, which have been provided as examples. Modifications are still possible, in particular from the point of view of composition of the various components or by substitution of equivalent techniques, without departing from the scope of protection of the invention.

Thus, in an embodiment variant not represented, the hinge device may comprise more notches to permit immobilizing the ironing board in more numerous positions.

Thus, in an embodiment variant not represented, the ironing board may be supported by a single pole equipped with a hinge device similar to the one described in the second embodiment illustrated.

Thus, in an embodiment variant not represented, the hinge device may be supported directly by the base.

Thus, in another embodiment not represented, the base may be connected to a smoothing tool, comprising a heating body containing an instant vaporization chamber, possibly in combination with a metal ironing soleplate. In this case, the base may be equipped with a steam generator, similar to the one described in the embodiment illustrated in the figures, to send the steam toward the smoothing tool, the instant vaporization chamber, integrated in the smoothing tool, then serving to vaporize any condensate transported by the steam; or the base may not be equipped with a steam generator but include a water tank and an electric pump to send the water from the tank toward the smoothing tool such that the steam is produced by the vaporization chamber integrated in the smoothing tool.

The invention claimed is:

1. A steam ironing and/or smoothing appliance comprising a smoothing tool comprising at least one hole for emission of steam and an ironing board against which a garment to be ironed can be placed for a steam treatment, the ironing board being mounted with the ability to pivot by a hinge device enabling the ironing board to be immobilized in various tilted positions, the hinge device comprising a first part which is mobile in rotation in relation to a second part, the first part comprising at least one notch in which is engaged at least one locking element carried by the second part in order to prevent the hinge device from rotating, the second part being mobile in translation in relation to the first part according to a course and a direction enabling the locking element to engage and disengage in the notch, wherein the hinge device comprises a finger, carried by either the first or second part, which is mounted with the ability to slide in a groove arranged in the other of the first or second part, the finger being configured to pivot freely in the groove.

2. The steam ironing and/or smoothing appliance according to claim 1, wherein the shape and position of the notch are adapted so that the locking element automatically engages in the notch under the effect of the weight of the ironing board.

3. The steam ironing and/or smoothing appliance according to claim 1, wherein the locking element is fixedly mounted on the second part.

4. The steam ironing and/or smoothing appliance according to claim 1, wherein the hinge device permits immobilizing the ironing board in at least one horizontal position, one vertical position and one intermediate position between the vertical position and the horizontal position.

5. The steam ironing and/or smoothing appliance according to claim 1, wherein the second part comprises several locking elements.

6. The steam ironing and/or smoothing appliance according to claim 1, wherein the locking element has the form of a cylindrical finger or a tooth.

7. The steam ironing and/or smoothing appliance according to claim 1, wherein the first part comprises several notches.

8. The steam ironing and/or smoothing appliance according to claim 1, wherein the notch is open at its upper end.

9. The steam ironing and/or smoothing appliance according to claim 1, wherein the notch is trapezoidal in shape.

10. The steam ironing and/or smoothing appliance according to claim 1, further comprising at least one pole which supports the ironing board, the first part being fixed to a top of the pole and the second part being fixed to the ironing board.

11. The steam ironing and/or smoothing appliance according to claim 10, comprising two parallel poles which support the ironing board.

12. The steam ironing and/or smoothing appliance according to claim 1, further comprising a base containing a water tank, the base being connected by a flexible pipe to the smoothing tool.

* * * * *